US008985205B2

(12) United States Patent
Nenniger

(10) Patent No.: US 8,985,205 B2
(45) Date of Patent: Mar. 24, 2015

(54) MULTI-STEP SOLVENT EXTRACTION PROCESS FOR HEAVY OIL RESERVOIRS

(75) Inventor: John Nenniger, Calgary (CA)

(73) Assignee: N-Solv Heavy Oil Corporation, Calgary (CA)

( * ) Notice: Subject to any disclaimer, the term of this patent is extended or adjusted under 35 U.S.C. 154(b) by 223 days.

(21) Appl. No.: 13/516,983

(22) PCT Filed: Dec. 20, 2010

(86) PCT No.: PCT/CA2010/002030

§ 371 (c)(1),
(2), (4) Date: Jun. 18, 2012

(87) PCT Pub. No.: WO2011/075835

PCT Pub. Date: Jun. 30, 2011

(65) Prior Publication Data

US 2012/0267097 A1 Oct. 25, 2012

(30) Foreign Application Priority Data

Dec. 21, 2009 (CA) ..... 2688937

(51) Int. Cl.
*E21B 43/16* (2006.01)

(52) U.S. Cl.
CPC ..... *E21B 43/16* (2013.01); *E21B 43/168* (2013.01)
USPC ..... 166/268; 166/269; 166/305.1; 166/266

(58) Field of Classification Search
USPC ..... 166/268, 269, 305.1, 266
See application file for complete search history.

(56) References Cited

U.S. PATENT DOCUMENTS 6,357,526 B1 * 3/2002 Abdel-Halim et al. .... 166/272.3
7,562,708 B2 * 7/2009 Cogliandro et al. ..... 166/248

FOREIGN PATENT DOCUMENTS

| | | |
|---|---|---|
| CA | 946737 | 5/1974 |
| CA | 948987 | 6/1974 |
| CA | 964577 | 3/1975 |
| CA | 964996 | 3/1975 |
| CA | 964997 | 3/1975 |
| CA | 967872 | 5/1975 |
| CA | 967873 | 5/1975 |
| CA | 971478 | 7/1975 |
| CA | 981576 | 1/1976 |
| CA | 982933 | 2/1976 |
| CA | 993792 | 7/1976 |

(Continued)

*Primary Examiner* — Zakiya W Bates
*Assistant Examiner* — Silvana Runyan
(74) *Attorney, Agent, or Firm* — Vidas, Arrett & Steinkraus, P.A.

(57) ABSTRACT

An in situ extraction process for heavy oil reservoirs using solvent comprises removing liquids and gases from areas contacting with the heavy oils to increase an interfacial area of unextracted heavy oil contactable by the solvent. Solvent vapor is injected into the areas to raise the reservoir pressure until sufficient liquid solvent is present to contact the increased interfacial area. The reservoir is shut in for a sufficient time for the solvent to diffuse into the unextracted oil across the interfacial area in a ripening step to create a reduced viscosity blend of solvent and oil. One or more reservoir characteristics is measured to confirm the extent of solvent dilution that has occurred of the unextracted oil in the reservoir. Gravity drainage based production is commenced from the reservoir upon the blend having a viscosity low enough to permit the blend to drain through the reservoir to a production well.

21 Claims, 11 Drawing Sheets

(56) References Cited

FOREIGN PATENT DOCUMENTS

| | | |
|---|---|---|
| CA | 1001066 | 12/1976 |
| CA | 1001067 | 12/1976 |
| CA | 1001068 | 12/1976 |
| CA | 1002871 | 1/1977 |
| CA | 1002872 | 1/1977 |
| CA | 1002873 | 1/1977 |
| CA | 1002874 | 1/1977 |
| CA | 1003328 | 1/1977 |
| CA | 1005338 | 2/1977 |
| CA | 1005339 | 2/1977 |
| CA | 1008361 | 4/1977 |
| CA | 1010361 | 5/1977 |
| CA | 1010779 | 5/1977 |
| CA | 1011644 | 6/1977 |
| CA | 1011645 | 6/1977 |
| CA | 1011647 | 6/1977 |
| CA | 1012884 | 6/1977 |
| CA | 1016862 | 9/1977 |
| CA | 1018058 | 9/1977 |
| CA | 1022843 | 12/1977 |
| CA | 1024066 | 1/1978 |
| CA | 1027850 | 3/1978 |
| CA | 1027851 | 3/1978 |
| CA | 1056718 | 6/1979 |
| CA | 1060784 | 8/1979 |
| CA | 1060785 | 8/1979 |
| CA | 1144064 | 4/1983 |
| CA | 1145247 | 4/1983 |
| CA | 1148854 | 6/1983 |
| CA | 1174163 | 9/1984 |
| CA | 1192485 | 8/1985 |
| CA | 1194783 | 10/1985 |
| CA | 1194784 | 10/1985 |
| CA | 1197771 | 12/1985 |
| CA | 1202881 | 4/1986 |
| CA | 1208539 | 7/1986 |
| CA | 1248014 | 1/1989 |
| CA | 2052202 | 4/1992 |
| CA | 2155035 | 4/1992 |
| CA | 2052558 | 4/1993 |
| CA | 2127105 | 7/1993 |
| CA | 2108349 | 11/1993 |
| CA | 2147079 | 10/1996 |
| CA | 2185837 | 3/1998 |
| CA | 2243105 | 8/1999 |
| CA | 2235085 | 10/1999 |
| CA | 2567399 | 10/1999 |
| CA | 2347786 | 5/2000 |
| CA | 2270703 | 10/2000 |
| CA | 2389760 | 5/2001 |
| CA | 2299790 | 8/2001 |
| CA | 2633061 | 8/2001 |
| CA | 2349234 | 11/2002 |
| CA | 2351148 | 12/2002 |
| CA | 2462359 | 9/2005 |
| CA | 2560851 | 10/2005 |
| CA | 2494391 | 7/2006 |
| CA | 2647973 | 10/2007 |
| CA | 2553297 | 1/2008 |
| CA | 2630682 | 6/2008 |
| CA | 2672487 | 6/2008 |
| CA | 2584712 | 10/2008 |

* cited by examiner

MULTI-STEP SOLVENT EXTRACTION PROCESS FOR HEAVY OIL RESERVOIRS

FIELD OF THE INVENTION

This invention relates to the field of hydrocarbon extraction and more particularly to the extraction of heavy oil from underground formations. Particularly, this invention relates to a multi-step heavy oil extraction technique to be used, for example, after primary extraction is no longer effective. Most particularly this invention relates to a solvent based multi-step enhanced extraction process for heavy oil.

BACKGROUND OF THE INVENTION

Heavy oil is a loosely defined term, but heavy oil is generally understood to comprehend somewhat degraded and viscous oils that may include some bitumen. Heavy oils typically have poor mobility at reservoir conditions so are hard to produce and have very poor recovery factors. Heavy oil is generally more viscous than light or conventional oil, but not as viscous as bitumen such as may be found in the oil sands. Heavy oil is generally understood to include a range of API gravity of between about 10 and 22 with a viscosity of between about 100 and 10,000 centipoise. For the purposes of this specification the term heavy oil shall mean oil which falls within the foregoing definition.

Heavy oil exists, in situ, in large quantities, but is difficult to recover. A recent (2003) estimate of the resource by the US Geological Survey, using an estimated recovery factor of 19% puts the theoretically recoverable heavy oil in North America alone at 35.3 billion barrels. This USGS estimate implies that the total domestic North American heavy oil resource is about 200 billion barrels and that more than 80% of this domestic heavy oil is unrecoverable using the best currently available extraction process technology. The USGS report also implies that the worldwide heavy oil resource is 3.3 trillion bbls and that 87% of this resource is unrecoverable or "stranded" with current technology. The commercial opportunity for a better extraction technology is therefore substantial. More specifically, an advance in extraction technology which raises the recovery rate of heavy oil from the current 13% level to only 25%, would contribute an additional 400 billion bbls of recoverable oil worldwide.

The bitumen containing oil sands of Canada have received a much attention due to their immense store of hydrocarbon. However, it would only take a tiny change in the average recovery factor for worldwide heavy oil from 13% to 18% of oil in place to provide an equivalent amount of oil to that which is considered recoverable from the Canadian oil sands. With concerns about peak oil and a limited scope for new reservoir discovery, the ability to recover stranded heavy oil is becoming increasingly important. Furthermore, being able to recover additional oil using energy efficient extraction technology is also very desirable. Solvent has long been recognized to have the theoretical potential to mobilize and recover the stranded heavy oil. Solvent would potentially not require the application of high temperatures and consequent liabilities of high energy consumption and greenhouse gas emissions which plague steam driven bitumen extraction processes for example.

It is currently understood by those skilled in the art, based on best available computer simulation models, that solvent diffuses quickly and deeply into in situ heavy oil. This is evident in the published results from computer simulations (Tadahiro et al, May 2005 JCPT pg 41, FIG. 18) that shows propane solvent penetrating 8 meters (25 feet) beyond the edge of a vapour chamber into a 5200 cp heavy oil. Similarly Das (2005 SPE paper 97924 FIG. 12) comments that it is realistic to expect propane solvent will penetrate 5 meters beyond the edge of the chamber in an Athabasca reservoir.

However, lab studies by the inventor (Nenniger CIPC paper 2008-139, FIGS. 1 and 2) have shown that the solvent extraction mechanism for heavy oil and oil sands is quite different than as predicted by the computer simulations. In particular, rather than easily diffusing deep into an oil bearing zone, the solvent is observed to form a well defined interface with undiluted oil at what might be called a concentration shock front. The concentration shock front arises because the solvent has a very difficult time diffusing or penetrating into the high viscosity oil like heavy oil or bitumen. In a sandpack experiment, the inventor observed asphaltene deposition within a pore length of the raw bitumen, which means that the concentration gradient is extraordinarily steep over a very small length scale.

The physical length scale of the dissolution process of solvent into heavy oil observed is that of individual pores, which are about 100 microns long in 5 Darcy sand. It seems reasonable to assume that two miscible hydrocarbon fluids such as oil and solvent should mix quickly and fairly easily as shown in the simulations of Tadahiro and Das. Consequently, the experimental observation of a concentration shock was surprising and unexpected. More specifically, the observation of a concentration shock front indicates that conventional wisdom regarding rapid dilution of heavy oil and bitumen via solvent diffusion is incorrect.

Many attempts have been made in the prior art to develop solvent based extraction processes. For example, U.S. Pat. No. 5,720,350 teaches a method for recovering oil left behind in a conventional oil reservoir after the original conventional oil has been recovered. This process uses gravity drainage from a formation in which an oil miscible solvent having a density slightly greater than a gas contained in a gas cap is injected above the liquid level in the formation. Following solvent injection the production of oil is commenced from a lower portion of the formation. The idea seems to be that the solvent sweeps the remaining oil to the production well. However, conventional recoveries are generally very good meaning that 30 to 60% or more of the oil in place can be recovered, consequently very large and potentially uneconomic volumes of solvent may be required to recover any significant portion of the remaining oil.

U.S. Pat. No. 5,273,111 teaches a laterally and vertically staggered horizontal well hydrocarbon recovery method, in which a continuous process is used combining gravity drainage and gas drive or sweep (ie pressure drive) to produce the oil from a specific configuration of vertical and horizontal wells. The configuration of the wells is said to be optimized to reduce coning and solvent breakthrough between the wells, but the use of a gas drive or sweep will result in preferential recovery through the higher permeability portions of the reservoir. Thus, even if the coning and solvent breakthough is reduced, it will still be significant, meaning that the drive process will likely bypass much of the stranded oil.

U.S. Pat. No. 5,065,821 teaches a process for gas flooding a virgin reservoir with horizontal and vertical wells which involves injecting a gas through a first vertical well concurrently with performing a cyclical injection, soak and production of gas through a horizontal well, to eventually establish connection to the vertical well, after which time the vertical well becomes the production well and the horizontal well becomes the injection well. Again this process teaches the continuous solvent gas injection (i.e. a pressure drive) through the reservoir once connection is established between the wells. During the initial steps, into a virgin reservoir it will be very difficult to get the solvent to diffuse into and dilute the oil making this process slow and impractical.

Canadian patent application 2494391 to Nexen discloses a further solvent based extraction technique which uses a continuous solvent injection or extraction of the type that may be characterized as a solvent sweep or drive with a pattern of horizontal and vertical wells. Again, however, any attempt to push out the oil with a solvent drive process is anticipated to lead to rapid coning, short circuiting, by-passing and only marginal recovery.

Notwithstanding these and many other prior attempts to perfect a solvent based extraction process for heavy oil, the results remain unsatisfactory. There is a clear need for a different and better understanding of how to effectively use solvent to improve heavy oil recovery, in a way that reduces bypassing of stranded heavy oil. What is desired is a solvent extraction process which comprehends this understanding of how slowly the solvent penetrates into the in situ heavy oil and addresses this problem directly.

SUMMARY OF THE INVENTION

The initial penetration of solvent into oil is now understood to be extremely slow. On the other hand, as soon as a small amount of solvent perhaps only one or two percent, has diffused into the oil held within in a particular pore, in a pay zone, the subsequent dilution of the partly diluted oil is very rapid. This results in a distinct solvent/diluted oil to heavy oil interface that advances slowly across the pay zone of a reservoir, on a pore by pore basis. The present invention teaches a method and process which comprehends this slow solvent front propagation and consequently has an objective of allowing effective and predictable mobilization and recovery of large volumes of stranded in situ heavy oil.

The present invention recognizes how difficult it is to achieve uniform dispersal of the solvent within the pay zone of the heavy oil reservoir and provides certain process steps to encourage solvent dilution and homogeneity. The presence of the shallow penetration and steep concentration gradient at the shock front means that the rate of solvent dilution into the stranded oil on a reservoir wide basis is limited by two key variables, namely the amount of stranded oil interfacial area available to the solvent and the amount of time the solvent is exposed to the interfacial area of the stranded oil. The degree of solvent dilution into the heavy oil determines the change in viscosity of the solvent oil blend, which in turn is directly related to the mobility of the heavy oil blend in the reservoir and the ability to recover the same through gravity drainage from a production well.

According to the present invention a process which maximizes the opportunity for dilution of the heavy oil with solvent will maximize the opportunities for recovery of the stranded heavy oil.

The present invention therefore consists of a procedure having several steps, including, increasing the interfacial area by removing solvent blockers from the voids created in the reservoir by the primary extraction process. Clearing out the voids allows more solvent to be placed in the reservoir permitting more solvent to contact more stranded oil thereby enabling the extraction process to proceed at much higher rates than would be possible in a virgin reservoir or even a partially extracted reservoir having voids filled with solvent blocking reservoir fluids and gases. Furthermore this invention comprehends providing enough exposure time for the solvent and oil in a ripening step to permit the solvent to slowly but adequately penetrate into oil filled pores and achieve a reasonable degree of homogeneity or dissolution at a micro scale level, throughout the reservoir. According to an aspect of the present invention the degree of in situ ripening is measurable to permit a determination of when to proceed to the next step of the extraction process, which is the actual production of the oil from the reservoir, through gravity drainage.

Therefore according to the present invention there is provided, in one aspect, a multi-step in situ extraction process for heavy oil reservoirs, said process using a solvent and comprising the steps of:

a. Removing liquids and gases from areas in contact with said heavy oils to increase an interfacial area of unextracted heavy oil contactable by said solvent;
b. Injecting said solvent in vapour form into said areas to raise the reservoir pressure until sufficient solvent is present in a liquid form to contact said increased interfacial area of said heavy oil;
c. Shutting in said reservoir for a sufficient period of time to permit said solvent to diffuse into said unextracted oil across said interfacial area in a ripening step to create a reduced viscosity blend of solvent and oil;
d. Measuring one or more reservoir characteristics to confirm the extent of solvent dilution that has occurred of the unextracted oil in the reservoir, and
e. Commencing gravity drainage based production from said reservoir upon said blend having a viscosity low enough to permit said blend to drain through said reservoir to a production well.

BRIEF DESCRIPTION OF THE DRAWINGS

Reference will now be made, by way of example only, to preferred embodiments of the present invention by referring to the following figures, in which.

DETAILED DESCRIPTION OF THE PREFERRED EMBODIMENTS

This present invention is most applicable to heavy oil reservoirs which have undergone a primary extraction and also which demonstrate good confinement. According to the present invention the primary extraction has resulted in an oil extracted region in the reservoir having either gas or water filled voids. A preferred reservoir has had a primary extraction which has recovered between about 5% and 25% of the original oil in place with a most preferred amount being between 8% and 15%. Most preferably a suitable target reservoir will have a significant pay thickness without extensive horizontal barriers so that when the viscosity of the in situ heavy oil is sufficiently reduced, gravity drainage can occur. While a primary extracted reservoir is preferred the present invention is also suitable for virgin reservoirs of the type having naturally occurring drainable voids having a volume of between about 5% and 25% of the original oil in place. An example of such a reservoir is one with a 20-40% water saturation and 60-80% oil saturation, but well confined reservoir in a porous formation.

Figure 1:
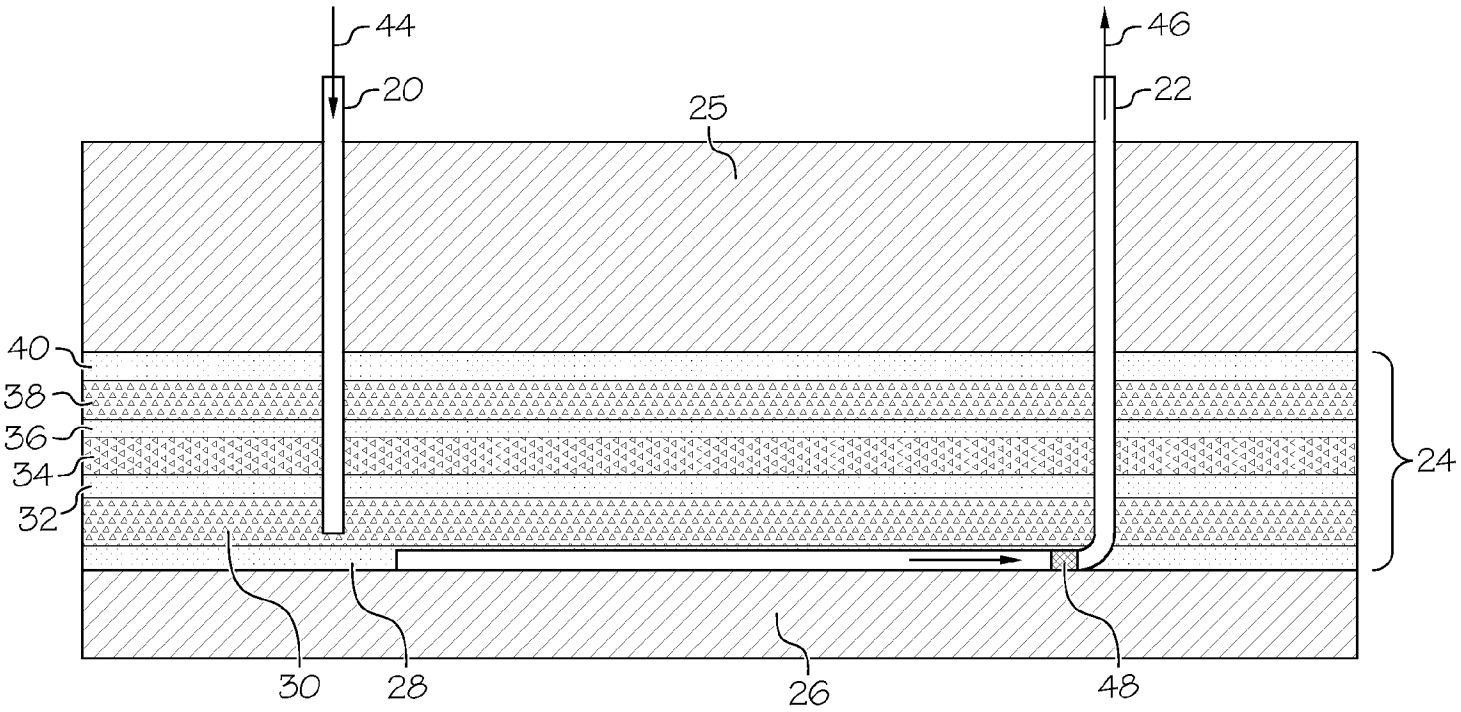
FIG. 1 shows a representation of target heavy oil reservoir with a horizontal well positioned near the bottom of the pay zone and a vertical injection well.

FIG. 1 shows a schematic of a target oil reservoir with a vertical well 20 and a horizontal production well 22. The horizontal well 22 is generally placed near the bottom of pay zone 24, and is a production well through which fluids draining through the reservoir by gravity drainage, can be removed. The typical pay zone 24 has layers of different permeability shown as 28, 30, 32, 34, 36, 38, and 40. Most preferably the pay zone 24 is confined by an impermeable overburden layer 25 and an impermeable under burden layer 26, but as will be appreciated by those skilled in the art of reservoir engineering, the present invention also comprehends that man made means for confinement can also be used. Preferably the pay zone 24 has been produced using conventional primary extraction techniques, such as CHOPS (cold heavy oil production with sand), to the full extent possible which has left significant void volumes in what may be called an oil extracted zone. Although the pay zone layers 28 to 40 may be fairly uniform there are typically some permeability variations due to, for example, the original depositional process. There is also typically some natural variation in the oil quality and viscosity with position in the reservoir.

As a consequence of the primary oil recovery from the reservoir, the highest permeability zones in the pay zone 24, in this case layers 30 and 38 will have been preferentially depleted of heavy oil, while the slightly less permeable zones 28, 32, 34, 36 and 40 will have been mostly bypassed thus having higher proportions of "stranded oil". If the reservoir was on primary depletion with no pressure support, the depleted regions will likely also have some gas saturation as the naturally occurring in situ dissolved gas comes out of solution and fills the pores as the oil is removed. Significant water or brine is also likely to be present in the voids of the extracted oil regions of the pay zone, especially where waterflooding has been applied. Solvent is being injected as shown by arrow 44 in vertical well 20 and a mixed solvent and oil blend 46 is being removed, for example by a pump 48.

Figure 2:
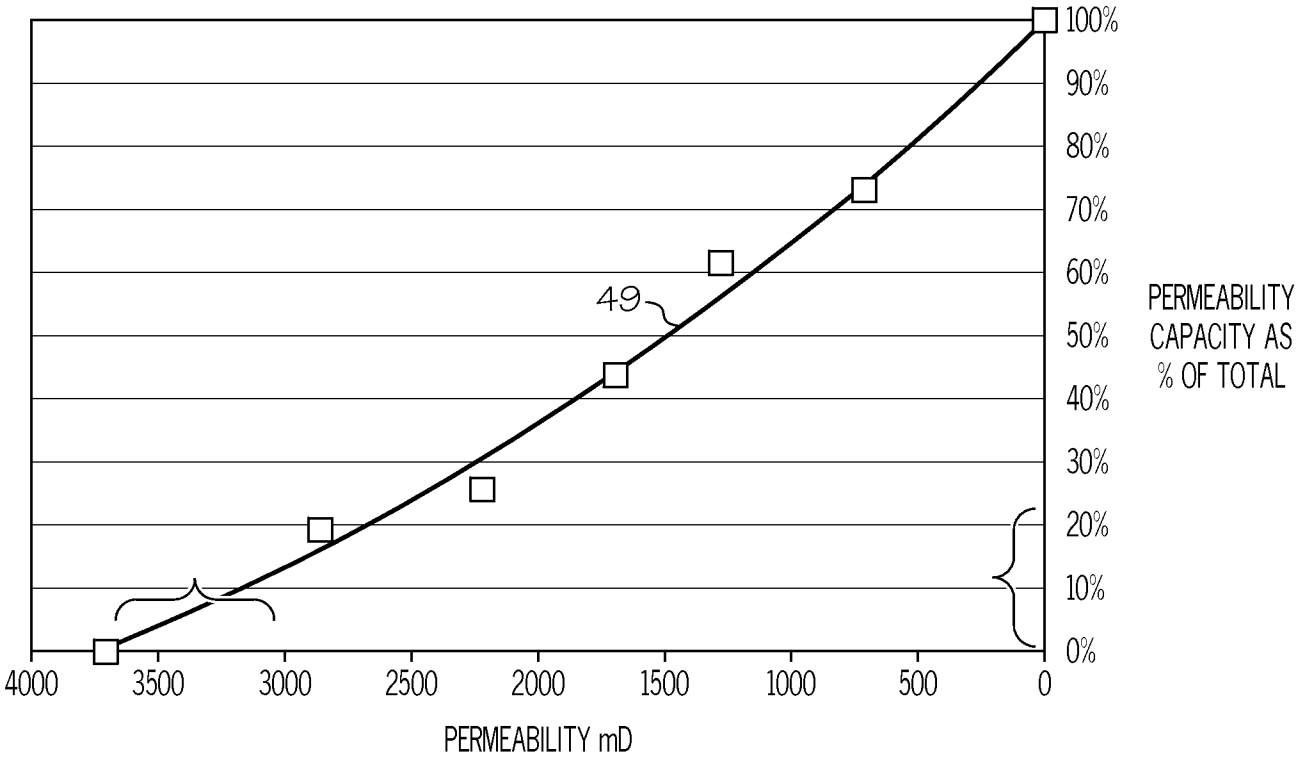
FIG. 2 is a graph of permeability in milli-darcies against total permeability for a typical heavy oil reservoir.

FIG. 2 shows with plot line 49 that an oil reservoir with a certain "average" permeability will typically encompass a large variety of different pore sizes and consequently will likely have a broad distribution of permeability that vary greatly from one pore to the next as well as from one layer to the next. This means that any gas or liquid drive based extraction process (where gas or liquid pressure is used to try to push the oil out of the formation) is vulnerable to preferentially movement of the sweep fluid, such as solvent, through the largest and highest permeability pores first thereby bypassing significant amounts of oil contained in smaller and lower permeability pores. This bypassed oil, which is not mobile at commercial recovery rates at reservoir conditions, is the stranded oil. This bypassing is particularly problematic for solvent type processes because the solvent will have a tendency to dissolve oil along the most permeable path and make the short circuiting or coning problem worse. There are a number of ways to physically measure and assess the heterogeneity of the natural permeability of the pay zone including logging tools and porosimetry measurements. In summary, FIG. 2 shows that a significant portion of the oil will be stranded in lower permeability pores within the pay zone.

Figure 3:
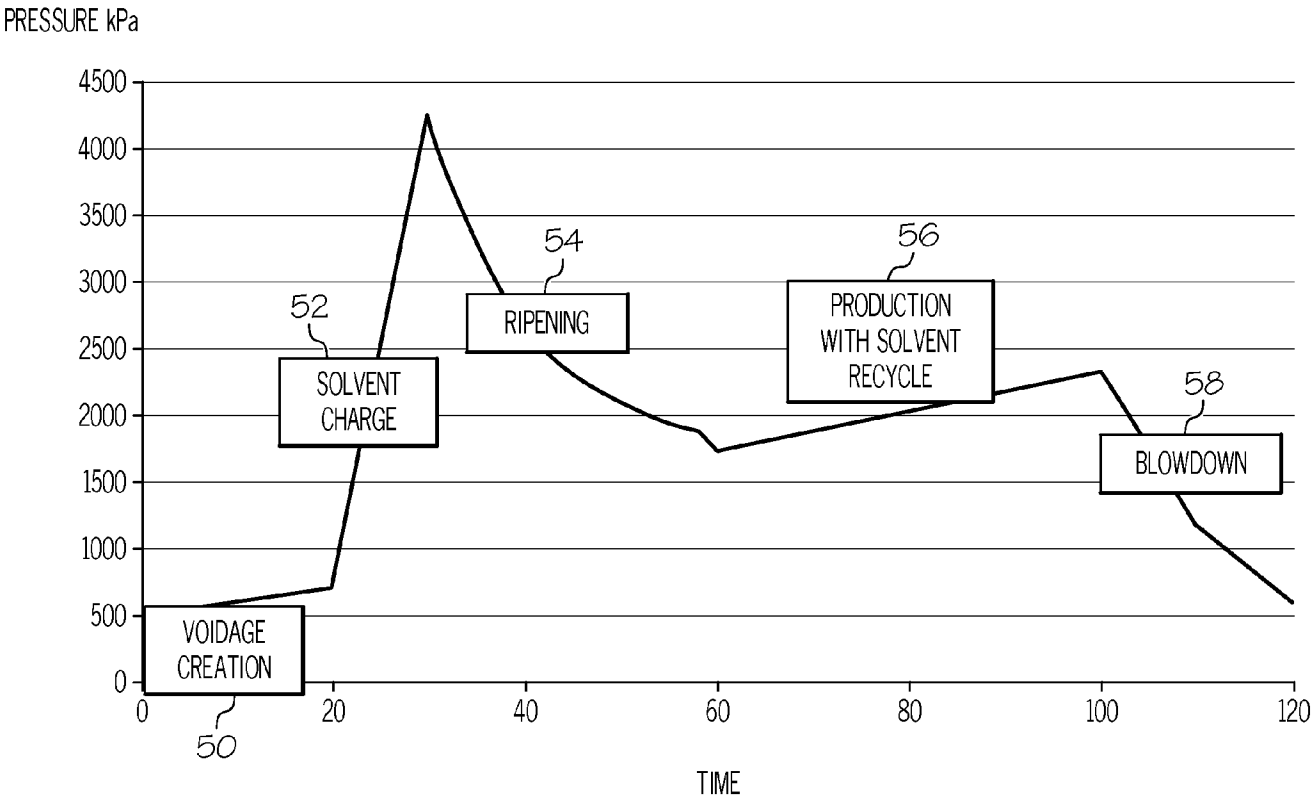
FIG. 3 is a graph of reservoir pressure vs. time for a sample reservoir according to the present invention.

FIG. 3 shows the sequence of steps for an extraction process according to a preferred embodiment of the present invention as a series of changes to the reservoir pressure over time. FIG. 3 shows the steps of voidage creation 50, solvent charging 52, ripening 54, oil production 56 with simultaneous solvent recycle back into the formation and solvent blowdown 58. Each of these preferred steps is discussed in more detail below. FIG. 3 illustrates a schematic plot of the process of the present invention being applied to a reservoir where the solvent is ethane and the initial reservoir temperature is 20 C and rises to about 24 C (see FIG. 4) with assumed values for the reservoir porosity and the viscosity of the stranded heavy oil.

The first step 50 of voidage creation occurs as a pretreatment or conditioning step. Mobile fluids and gases, which for ease of understanding are referred to as solvent blockers, are pumped or produced from the reservoir. Most preferably these solvent blockers can be extracted through existing wells that are left over from the primary extraction step, but in some cases it may be preferable to install a horizontal well towards the bottom of the formation and use that for removal of the solvent blockers. The most potent solvent blockers are believed to be water, brine and methane, all of which are likely present after the primary extraction process is no longer effective. Creation of additional voidage in the pay zone 24 can be further encouraged by introducing into the reservoir a relatively low pressure solvent vapour to remove as much solution gas and methane as possible. The preferred solvent is ethane, although propane may also be suitable in certain reservoir conditions. The choice of solvent will depend on certain factors including both the effectiveness of the solvent at the pressure of the reservoir (which is often a function of the depth of the reservoir) and the cost at that time of the solvent on the open market. It is preferred to use ethane for reservoirs located below 1000 feet, and propane in reservoirs that are more shallow than that. The voidage creation of the present invention comprehends a series of displacement steps in an organized pattern to maximize recovery of water and methane gas from the pay zone 24 of the formation. As such the present invention will take advantage of whatever existing well configuration might be left over from primary extraction.

Solvent purity is also an important aspect of the present invention. In any environment with mixed solvents, the more readily dissolving species will preferentially enter into solution with the oil, leaving the less readily dissolving species at the oil interface. Over a period of time therefore, the less soluble species becomes concentrated at the oil interface, and blocks the passage of the more readily dissolving solvent species into the oil, frustrating the process of dilution of the oil. Therefore, an aspect of the present invention is to replace relatively insoluble species, such as methane, that might be naturally present in the formation, with high concentrations of reasonably pure solvent such as ethane, or propane to prevent the less readily dissolving species from slowing down or preventing dilution. As well, water, between the oil and the solvent will act as a barrier to the solvent, and so is also preferably removed according to the present invention, from the void volumes, to the extent possible. In summary, a solvent blocker may be either a gas or a liquid at reservoir conditions, and are advantageous to be removed.

The present invention comprehends that the voidage creation step can be done with or without pressure maintenance, depending on the reservoir conditions. In some cases it will be necessary to use pressure maintenance to minimize inflow from an active aquifer during the voidage creation and subsequent solvent charging step. In other cases, the reservoir may be sufficiently isolated and stable enough to not require any such pressure maintenance. However the present invention comprehends both types of voidage creation, depending upon which is most suitable for the specific reservoir conditions.

The next step 52 in the present invention is solvent charging. This involves continuing to introduce solvent, as a vapour, into the reservoir to carefully raise the pressure in the formation until it is above the bubble point pressure of the solvent vapour. By introducing the solvent as a vapour the present invention attempts to extend the reach of the solvent into the furthest voids, and then by increasing the pressure above the bubble point, to fill all of the voidage volume created in the first step with liquid solvent. It is preferable to inject most of the solvent as a vapour to permit the solvent to easily penetrate the voids throughout the pay zone 24 without forming liquid or other barriers to further solvent penetration. The present invention comprehends that at the final stages of the injection the injection pressure will be high enough that most of the solvent is in a dense liquid like phase. This is required to provide sufficient volume of solvent to adequately dilute and thereby mobilize enough of the stranded oil. For this overcharging step, injection pressure has to be monitored carefully to avoid the risk of a possible loss of confinement of the reservoir with a consequential loss of solvent.

There are several strategies for solvent injection or charging according to the present invention, depending upon the reservoir. Most preferably the solvent charging will occur in a way that permits the solvent to penetrate the voids created in the first step of the process. In some cases this is best accomplished by means of an existing vertical well that accesses a high permeability zone in the reservoir. It might also be preferable to use packers or the like in a vertical well to ensure that the solvent is being placed in an appropriate void zone in the reservoir. As well, if there is significant removal of blocking fluids from a sump by means of a horizontal well, then solvent may also be injected through the horizontal well. What is desired according to the present invention is to place the solvent, as close as possible, to the voids created during the first step of the present invention, to try to fill those voids to fullest possible extent. Exactly how to do this will vary with the specific reservoir geology and characteristics but could be through one or more vertical wells and horizontal wells simultaneously.

The next step of recovery according to the present invention is a time delay or ripening step 54 in which sufficient time is provided for the solvent to slowly diffuse into the oil in the smaller less accessible pores, to dilute the oil contained therein and to reduce its viscosity such that the fully diluted or homogenized combination will be mobile within the formation. This homogenization process is also important to permit the oil to seep into the solvent filled pores, even as the solvent is seeping into the oil filled pores. Such a homogenization of the solvent in the oil will according to the present invention help deter the solvent from bypassing the oil during the production phase. In an adequately confined reservoir, the ripening step will be characterized by a reservoir pressure that decays with time as the relatively pure solvent becomes diluted with oil and its vapour pressure is reduced. This drop in reservoir pressure is in accordance with Henry's law. Pockets of pure solvent will tend to maintain a high pore pressure, representative of the vapour pressure of pure solvent. The shape of the pressure decline curve and an assessment of whether the pressure has reached an expected asymptote provide, according to the present invention, a useful diagnostic of the degree of homogeneity of the solvent within oil across the reservoir. In particular, a lack of pressure decay from an initial charged solvent pressure is indicative of poor solvent penetration.

The present invention comprehends different ripening times for different reservoirs. One of the variables is the diffusion distance, which in some cases can be estimated when the reservoir permeability and heterogeneity is known. The present invention further comprehends being able to predict an optimum amount of time for the ripening step based on the reservoir heterogeneity and physical data about the oil. For example, the oil dilution rate will vary and a light oil with a high initial void fraction may achieve homogeneity within a short time, such as a day, but a high viscosity bitumen, with a low voidage (and solvent) distribution may require a long time, perhaps even decades.

It can now be understood why achieving a reasonable degree of uniform penetration or absorption of the solvent in oil is desired according to the present invention. Where two fluids exist in the reservoir, one having a significantly lower viscosity than the other, the more mobile species will be preferentially produced. By achieving a reasonable degree of heterogeneity, there becomes substantially only one fluid present, namely oil diluted with solvent, increasing the chances that the oil will be fully mobilized which can greatly reduce solvent bypass and coning. Each reservoir will, according to the specifics of the reservoir, will likely have a unique maximum total recovery, due to natural anomalies and the like. However, the present invention comprehends allowing the ripening step to progress to the maximum extent possible, given the conditions, such as void volume, to realize as much production as possible of the oil in place from the pay zone. The present invention also comprehends that while production can start from one area of the pay zone, slow solvent dilution of the oil can still be occurring in another area, and so it may not, in all cases, be necessary to wait until dilution has been maximized throughout the reservoir, to begin the recovery step, in cases where production in one part does affect ongoing solvent dilution in another part.

However, if the ripening step is terminated too quickly, then one would expect to see fluid production which is mostly solvent containing only a small proportion of oil. This outcome is typical of many prior art reservoir drive processes, where the low viscosity of the drive fluid (i.e. solvent, or steam or water or gas) bypasses most of the target oil. Consequently, high concentrations of solvent in the produced fluid can provide a useful diagnostic criteria to assess whether the ripening time has been sufficient, at least in the near production well bore area.

The next step of the present invention is a production step 56. Assuming, for example, a sufficient solvent volume was injected to achieve a certain volume fraction of solvent in the oil, then, the production fluids will be carefully monitored to determine if the solvent fraction exceeds this target fraction. If the liquid solvent volume fraction in the produced solvent/oil blend is larger than expected, then the solvent has not been successful at diluting all of the stranded oil that should be accessible to it and is likely bypassing significant amounts of oil. If the liquid solvent production rate is too high relative to the oil rate then the oil production rate can be restricted or the reservoir can be shut in again to allow the ripening step 54 further time to proceed towards more complete dilution.

As noted above the oil production step will also co-produce solvent dissolved in the oil. According to the present invention, this solvent may be recycled back into the formation or the solvent may be sold or shipped to a subsequent recovery project or even flared or burnt as fuel gas.

The pressure, during production could also be augmented according to the present invention by solvent recycle or additional solvent injection if it was desirable to keep the solvent concentration in the oil high enough to reduce the oil viscosity to a particular target value. This offers the possibility of increasing the solvent to oil ratio with time which might be helpful to maintain high oil production rates without excessive coning as the reservoir becomes depleted in oil. However, additional solvent injection also increases the risk of solvent de-asphalting and potential for formation damage. It may be desirable to inject a non-solvent fluid such as methane, nitrogen or the like for pressure maintenance towards the end of the production step, when adequate solvent is in the oil and solvent blocking across the interfacial area is no longer a concern.

The final step in the extraction procedure is the solvent blowdown and recovery 58. If there are pressure constraints such as an active aquifer it may be desirable to sweep the solvent out using another gas like methane, carbon dioxide or nitrogen.

Figure 4:
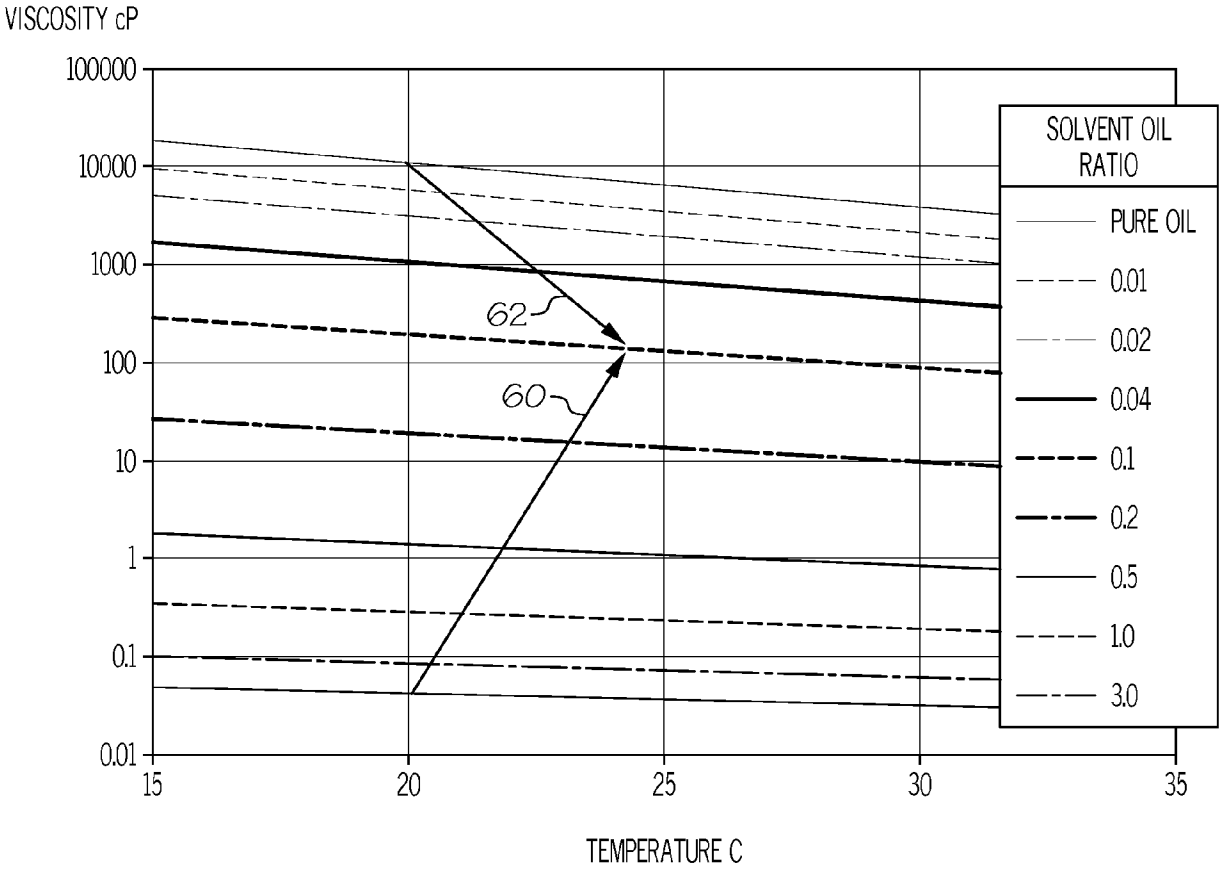
FIG. 4 shows a viscosity vs temperature graph for various solvent to oil ratios of solvent diluted heavy oil.

FIG. 4 shows a viscosity graph for a typical heavy oil as a function of solvent dilution and temperature. This graph allows the viscosity reduction from the application of a particular quantity of solvent to a particular heavy oil to be estimated. The graph also shows that the viscosity of pure solvent may be 100,000 times lower than that of the native oil so the ripening step 54 giving the solvent enough time to dilute the oil is very important to avoid the solvent bypassing the oil. According to the present invention similar graphs can be constructed for other oil solvent combinations. The beginning of the arrows 60 and 62 represents the viscosity of the pure unheated solvent and heavy oil reservoir fluid and the arrowheads show that the homogeneous oil solvent blend will have a viscosity just over one hundred centipoise. The graph shows a small temperature rise for this example due to the latent heat of condensation. However, it is clear in this particular case that the temperature rise does not provide a meaningful viscosity reduction. The graph of FIG. 4 also permits the predicted viscosity to be assessed for the homogeneous solvent-oil blend at different solvent volume fractions. For example increasing the solvent volume to 20% would allow the blend viscosity to be dropped by a further factor of 10 to a value of about 13 cP.

Figure 5:
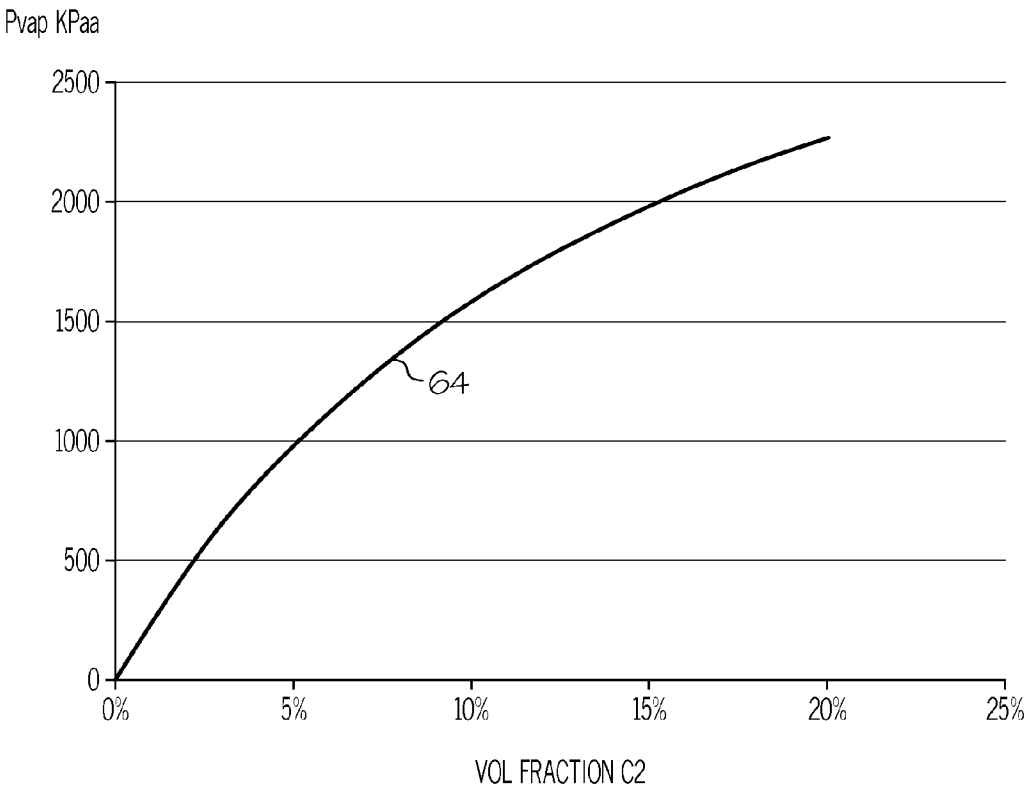
FIG. 5 shows a plot of the vapour pressure of a specific solvent, ethane, as a function of volume fraction of ethane dissolved in a heavy oil, according to the present invention.

FIG. 5 shows a curve 64 of the expected vapour pressure of a preferred solvent species ethane as a function of the volume fraction of ethane dissolved in the heavy oil. The saturation pressure for pure ethane at 24 C is about 4100 kPa (absolute), so this is the level of injection pressure that is the minimum required to fill the voidage volume with liquid equivalent ethane. The total pressure will be somewhat higher depending on the residual amount of methane remaining in voidage at the end of the first step of voidage creation. However, with a 10% volume fraction of ethane in the oil the ethane vapour pressure is only about 1600 kPa (absolute). This means that if the ripening step achieves a homogeneous blend of oil and solvent, the partial pressure of ethane will drop from 4100 kPa (absolute) to about 1600 kPa (absolute). Thus according to the present invention the reservoir pressure will asymptote at a value that is about 2500 kPa below the injection pressure. As will be understood by those skilled in the art, this assumes that the reservoir is confined and that there is no pressure maintenance via an aquifer or gas cap.

Interestingly, if someone assumed that the solvent penetrates deeply as shown in the computer based models of Das and Okazawa, they could only interpret a pressure decline as a loss of solvent to a thief zone and consequently would limit further solvent injection would begin to recover the solvent as fast as possible. This appears to be the teaching behind U.S. Pat. No. 2,494,391 which uses very high pressure gradients to inject and remove solvent from the formation as fast as possible.

Figure 6:
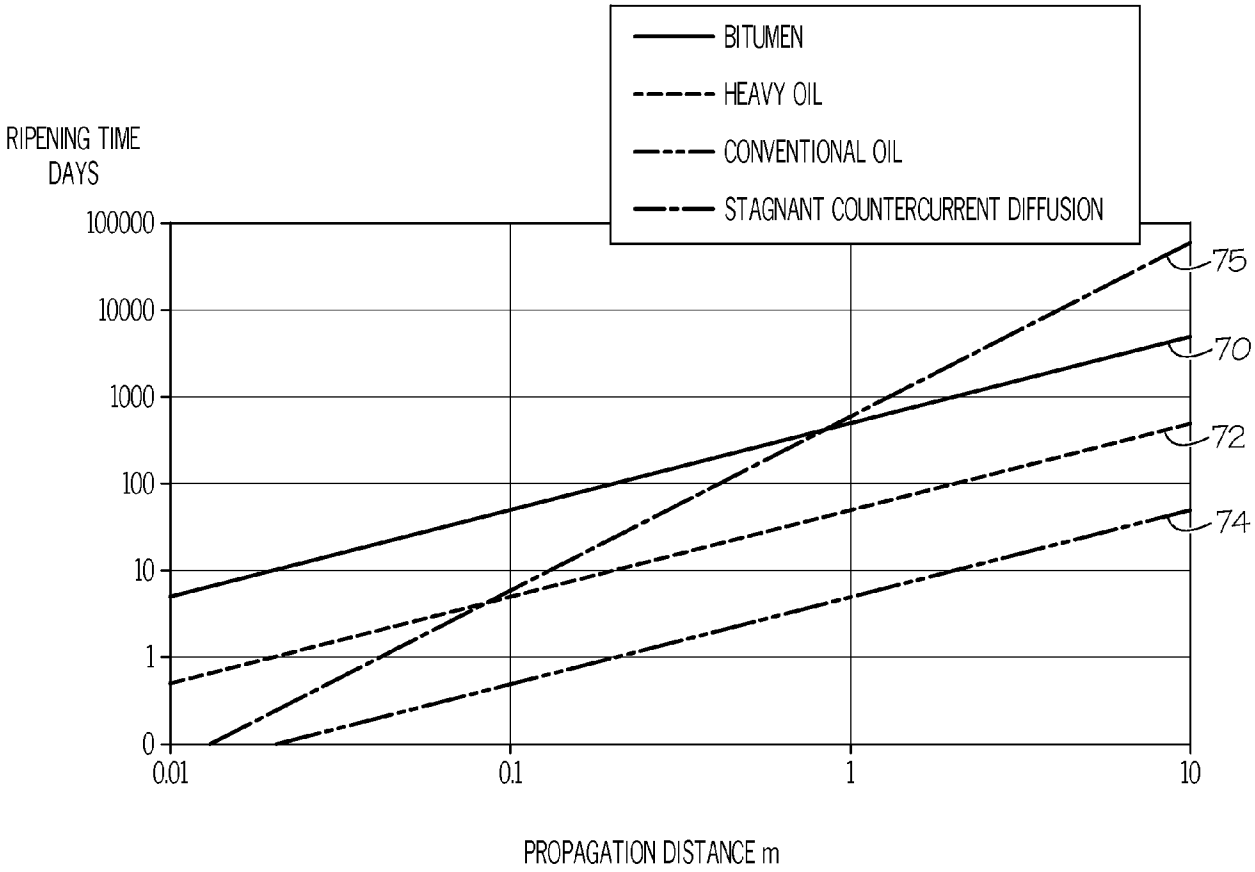
FIG. 6 shows the time in days for the solvent to travel a specified distance through a heavy oil reservoir by dilution of the heavy oil according to the present invention.

FIG. 6 shows the approximate time required for the ripening step 54 as a function of the distance the solvent front must travel into the pay zone 24 for target reservoirs having in situ hydrocarbons ranging from bitumen to conventional oil, with the plots 70 for bitumen, 72 for heavy oil and 74 for conventional oil shown. This FIG. 6 also shows the benefit of the initial voidage creation step 50 which increases the amount of solvent that can be safely injected into the target reservoir in step 52, so that the distance the solvent must diffuse is reduced and the length of time required for the ripening step 54 is also reduced. One might expect for example that doubling the amount of solvent from 10% to 20% might disperse the solvent more effectively in the target oil recovery zone and cut the ripening time in half.

The conventional oil reservoir with the pay zone 24 is assumed to contain 10 cP oil and have 100 millidarcies perm. The heavy oil reservoir is assumed to have 1 darcy permeability and oil viscosity of 10,000 cP and bitumen example is assumed to be 5 darcies permeability and 6 million cP bitumen. The duration of time for the ripening step 54 is set by the speed that a concentration shock front will propagate through the reservoir. The propagation speed is derived from the correlation presented in the inventor's previous U.S. Pat. No. 2,591,354.

FIG. 6 also shows another curve 75 labeled stagnant countercurrent diffusion, which is a second way of estimating the solvent diffusion rate within the reservoir. The curve 75 assumes that the solvent penetration or propagation distance is proportional to square root of ripening time for this estimation model. The countercurrent model has somewhat faster penetration rates at short distances and much slower penetration rates at longer distance for a particular heavy oil. Although the particular choice of solvent penetration rate model requires field calibration, one conclusion from both models, is that the solvent penetration time can be extremely long (years to decades) for relatively short propagation distances. Consequently, the benefits of the present invention, in getting a widespread dispersal of the solvent by removing solvent blockers, and to minimize the distance the solvent must travel to contact stranded heavy oil can now be appreciated.

Figure 7:
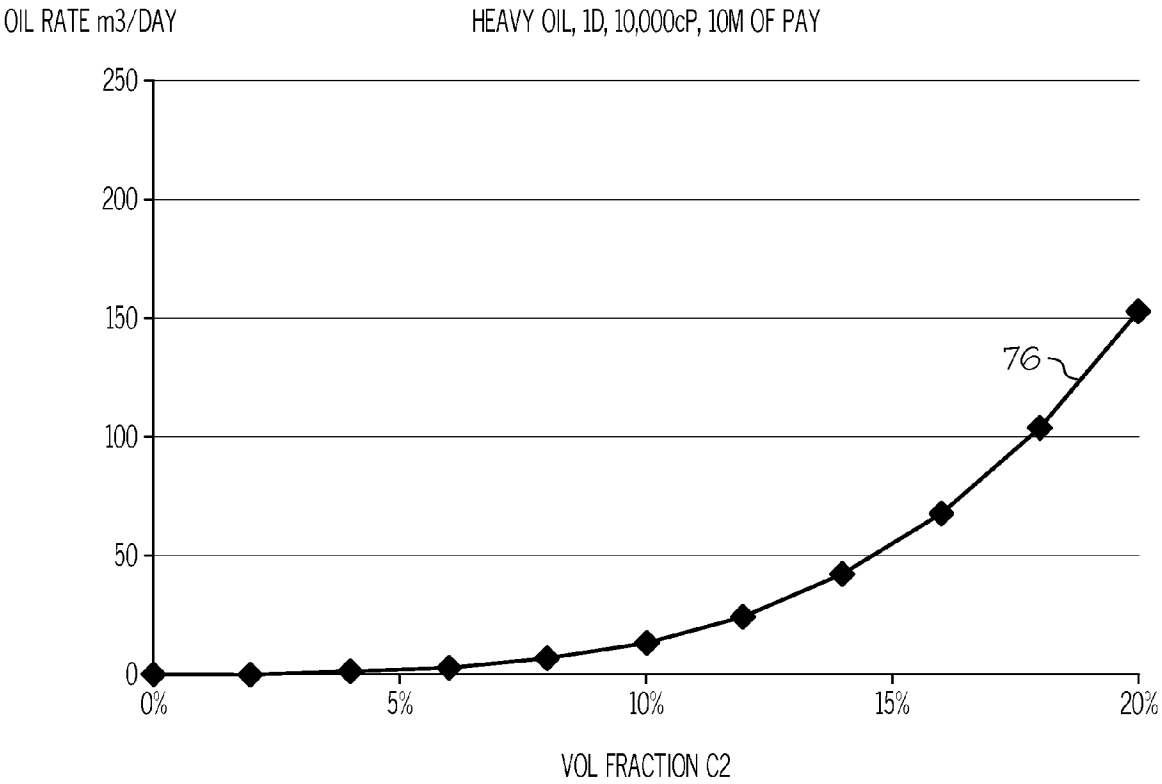
FIG. 7 shows a calculated oil production rate for an 800 m long horizontal well with 10 m of pay as a function of the degree of dilution of the solvent in oil for an average 1 Darcy permeability reservoir according to the present invention.

FIG. 7 shows a plot 76 of the expected gravity drainage oil production rate for a 800 m long horizontal well with 10 m of pay for a heavy oil that is 10,000 cP at original reservoir conditions. This graph shows that for an average perm of 1 Darcy, the expected oil rate is only about 10 m3/day. FIG. 7 shows the importance of achieving a sufficient concentration of solvent in the oil; doubling the solvent concentration from 10% to 20% by volume in the oil increases the oil production rate by 15 fold. Furthermore, solvent volume fractions below 10% appear to be totally futile.

Figure 8:
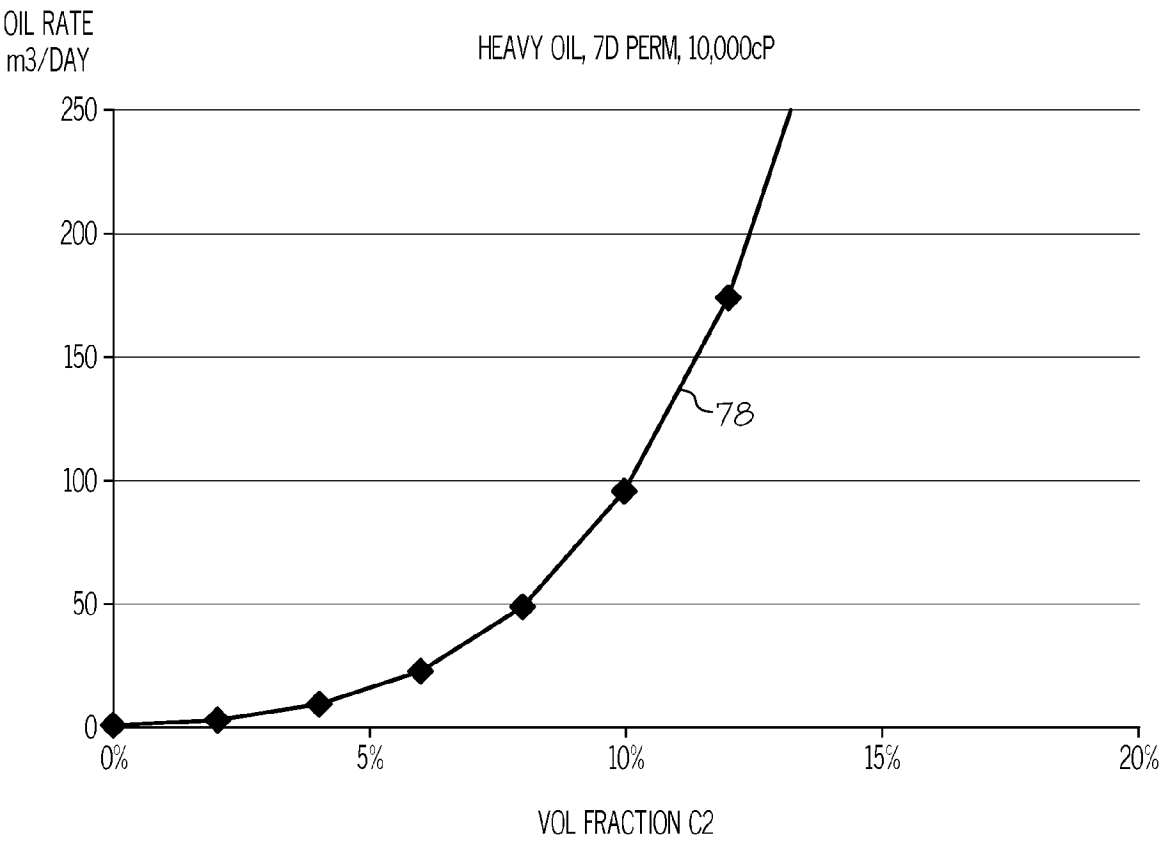
FIG. 8 shows a calculated oil production rate for a 800 m long horizontal well with 10 m of pay as a function of the degree of dilution of the solvent in oil for an average 7 Darcy permeability reservoir according to the present invention.

FIG. 8 shows a plot 78 of the expected gravity drainage oil production rate for the same well and oil of FIG. 7 but having an average reservoir permeability of 7 Darcies. FIG. 8 shows that a for a 10% volume solvent charge with average reservoir permeability of 7 Darcy, the expected oil recovery rate is as high as 100 m3/day. This figure shows that pay zones with higher permeability are highly preferred, for the present invention because they reduce the amount of solvent required to achieve a given production rate. It is preferred that most of the solvent be recovered and recycled, in which case the solvent cost can be largely recovered.

Figure 9:
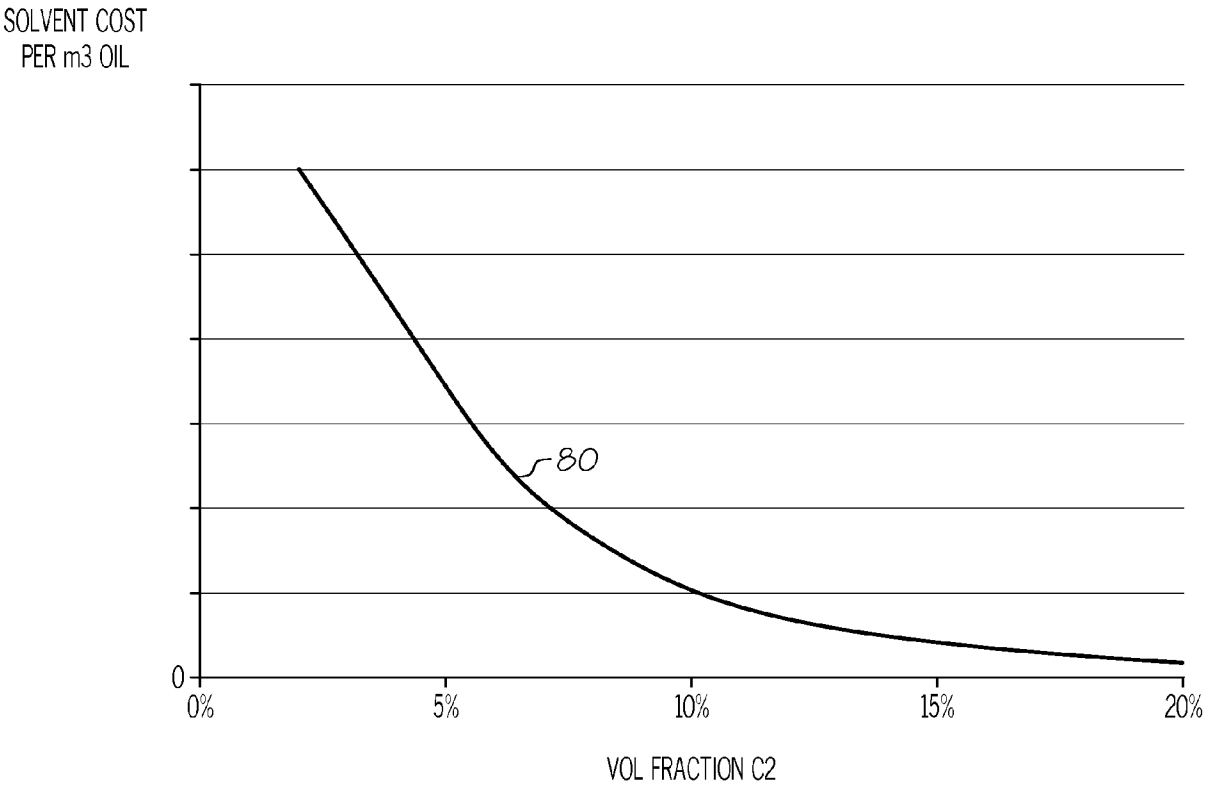
FIG. 9 shows the calculated solvent cost per cubic meter of oil recovered for the 7 Darcy heavy oil reservoir of FIG. 7, as a function of the volume fraction of solvent in the oil (in this case ethane or C2) assuming the solvent is eventually recovered during the blowdown according to the present invention.

FIG. 9 depicts with plot 80 the calculated solvent cost for the 7 Darcy heavy oil reservoir of FIG. 8, assuming the solvent is eventually recovered, either from the produced solvent/oil blend or during the final blowdown. FIG. 9 shows that the solvent cost per m3 of oil production is reduced as the volume fraction of solvent increases in the produced solvent oil/blend. This is a surprising result and shows that the larger solvent inventory cost is more than offset by the reduced (faster) recovery time (based on the time value of money) to produce the stranded oil. Consequently, it shows that a process which aims to be frugal with the amount of solvent used, like much of the prior art, is not cost effective for maximizing value. FIG. 9 further reinforces the benefit of the initial voidage creation step according to the present invention, which permits the volume of solvent is delivered in close proximity to the stranded oil to be maximized.

Figure 10:
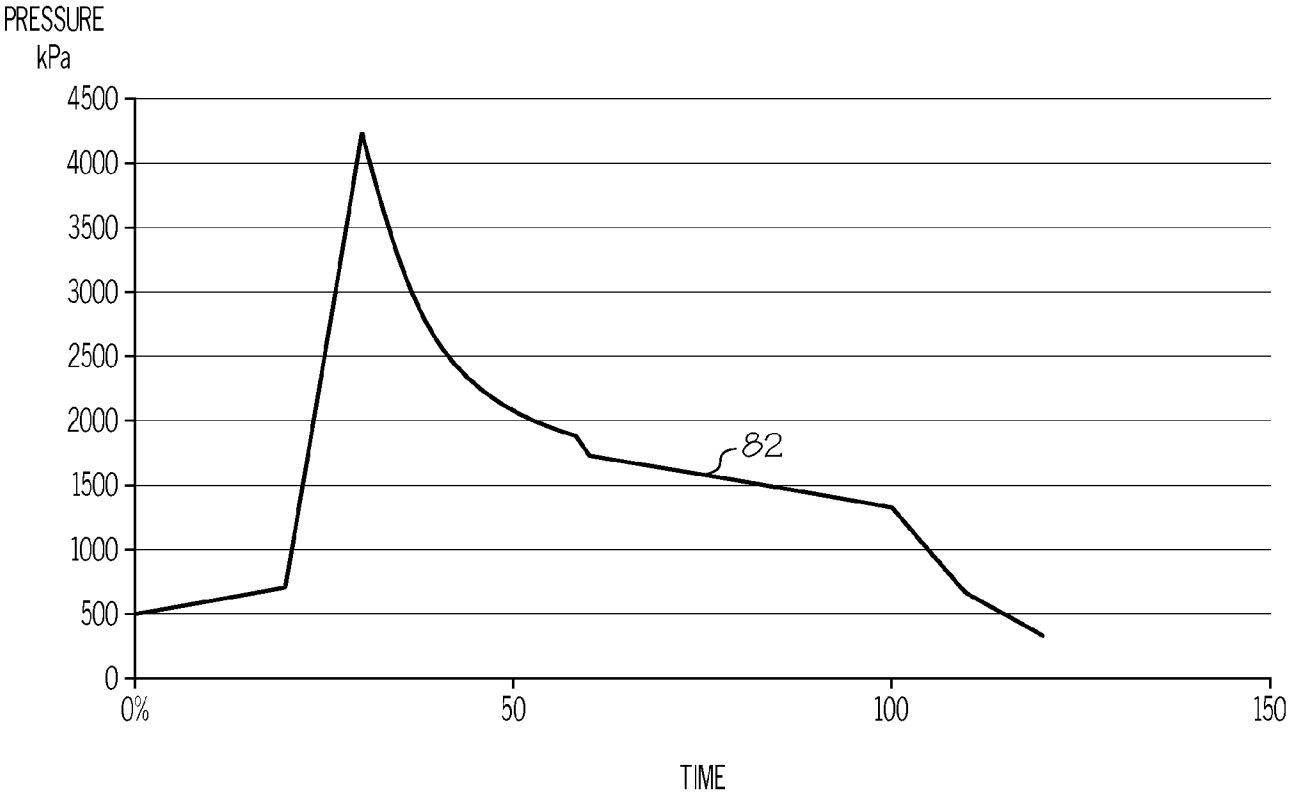
FIG. 10 shows the reservoir pressure versus time according to the present invention in the case where the solvent which is coproduced with the oil is not subsequently re-injected back into the reservoir.

FIG. 10 shows a graph line 82 of the reservoir pressure versus time in the case where the solvent which is co-produced with the oil is not subsequently reinjected back into the reservoir formation. As shown by the slope of the graph the reservoir pressure declines slightly over time during the production phase. It will be understood that this decline is not attributed to further dilution of the solvent into the oil, but rather by reason of the removal of the produced fluid volume from the pay zone in a well confined reservoir as taught by this invention.

Figure 11:
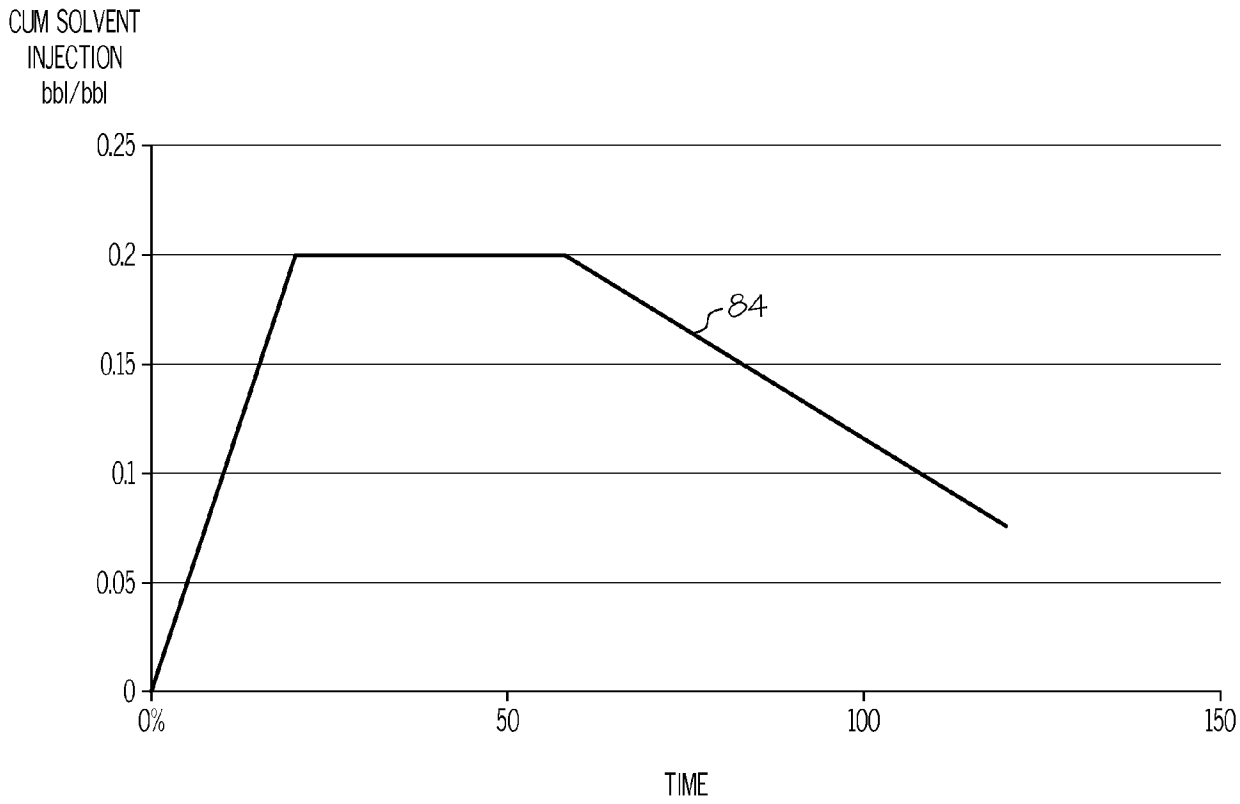
FIG. 11 shows the calculated injection and production volumes as a function of time for the extraction process of the present invention when applied to a reservoir having an active aquifer or other type of pressure support, so that the reservoir pressure is effectively constrained to a constant value.

FIG. 11 shows with plot 84 the cumulative solvent injection and production volumes as a function of time for the present invention when applied to a reservoir having an active aquifer or other type of pressure support. This type of reservoir is less desirable since the quality of the solvent dilution into oil and the appropriate ripening time cannot be assessed by means of remotely sensing the reservoir pressure because the reservoir pressure is effectively constrained at a constant value. It will be understood that the present extraction process invention can still be usefully applied to this type of reservoir but the assessment of the appropriate ripening time will be more uncertain, may rely more on the evaluation of the solvent to oil ratio of the produced fluids and will benefit from a detailed assessment of reservoir heterogeneity.

The advantages of the present invention can now be more clearly understood. Although the volume of solvent introduced into the reservoir is maximized by the precondition step of the present invention, the solvent concentration in the produced fluid is quite small, as the primary and secondary recovery is frequently in the 10% to 20% range of the original oil in place. Consequently, the amount and value of the solvent that is co-produced with the oil is greatly reduced over other prior art processes such as 2,299,790. The present invention comprehends that it may be cost effective to completely ignore solvent recovery in some cases to minimize field plant capital cost. Another advantage of the present invention is little or no asphaltene deposition is expected due to the relatively low solvent to oil ratio. On the other hand, little or no upgrading of the crude oil is expected. As well, the present invention is not a continuous process, as the full solvent charge is required almost from the start—during the ripening step no significant plant operating expenses are going to be incurred.

In addition, it is possible to use a variety of solvents. FIG. 6 shows that a ripening time of one month might allow a preferred solvent to propagate 5 meters in a conventional oil reservoir. However, it is expected that 6 or more years would be required for unheated solvent to diffuse 5 meters in very viscous bitumen of the oil sands. Additional commercial advantages include the potential of acquiring land with wells and production facilities for a low cost if a particular depleted heavy oil reservoir is perceived to be uneconomic to operate.

Additional novel aspects include, among other things, the following:

The cleanup/decontamination step to create void volume and get rid of undesirable contamination such as water and methane;

Use of solvent detectors to monitor solvent breakthrough in decontamination step;

a pressurization step to achieve bubble point condition, so the voids can be charged with highest possible solvent loading;

a ripening step with the tracking of reservoir pressure decay to monitor the progress of the mixing; and monitoring solvent/oil ratio to detect and mitigate solvent coning and bypassing The benefit of the present invention in using gravity drainage is that it can enable 60% or higher recovery of initial oil in place. If the primary only recovers 10% of the original oil in place then subsequent solvent assisted gravity drainage could allow 5 or more times cumulative oil production than was achieved in the primary and secondary production cycles.

Example: Consider a Lloydminster heavy oil with a native reservoir viscosity of 10,000 cP and a reservoir permeability of 7 Darcy and a pay thickness of 10 m. Recovery after primary CHOPS and subsequent water flood is 270 kbbls which is 15% of initial oil in place. In the first step of the present invention the reservoir pressure is dropped to 500 kPAa as solvent blockers consisting of water brine and methane are removed. Solvent vapour is then injected to help displace mobile water and methane from the reservoir and to permit the solvent vapour to spread out through the accessible reservoir voids.

This drainage step creates a void volume of 15% of the pore space, which can be subsequently filled with solvent. Sufficient ethane solvent is injected to fill this 15% void volume with liquid equivalent solvent (i.e. 270 kbbl liquid equivalent barrels of ethane). Assuming the voidage that was created during primary extraction was created primarily at the bottom of the pay zone, then the solvent must diffuse about 10 meters to homogenize across the full height of the reservoir. The required ripening time is estimated to be approximately one year. After the solvent injection, the reservoir pressure is measured until a decline from 4600 kPa to 3000 kPa is detected.

The reservoir is then put on production via the horizontal well and the initial oil rate is calculated to be 250 $m^3$/day (1500 bopd) or more. The production fluids are carefully monitored to make sure that solvent isn't short circuiting. Assuming uniform solvent dilution of the stranded heavy oil, approximately 820,000 additional barrels of heavy oil are calculated to be available to be produced over the next 3 years. Towards the end of the production cycle the oil production rate will decline and the blowdown cycle is commenced to recover as much remaining solvent as can be had. At the end of the production cycle, it is calculated that each barrel of solvent injected has enabled the recovery of 3 additional barrels of oil. At current prices the ethane solvent cost is $13/bbl and the oil can be sold at $60 per barrel. Thus the solvent cost, with no solvent recovery at all, is about $4 per bbl of oil or −6% of the oil value.

It will be appreciated by those skilled in the art that although the invention has been described above with respect to certain preferred embodiments, that various alterations and variations are comprehended within the broad scope of the appended claims. Some of these have been discussed above, while others will be apparent to those skilled in the art. For example, while the solvent may be injected initially through a vertical well, it may also be injected through a horizontal well or both even at the same time during the solvent charging step. The present invention is intended to be only limited by scope of the claims as attached.

The invention claimed is:

1. A multi-step in situ extraction process for heavy oil reservoirs, said process using a solvent and comprising the steps of:

a. removing liquids and gases from areas in contact with said heavy oils to increase an interfacial area of unextracted heavy oil contactable by said solvent;

b. injecting said solvent in vapour form into said areas to raise the reservoir pressure until sufficient solvent is present in a liquid form to contact said increased interfacial area of said heavy oil;

c. shutting in said reservoir for a sufficient period of time to permit said solvent to diffuse into said unextracted oil across said interfacial area in a ripening step to create a reduced viscosity blend of solvent and oil;

d. measuring one or more reservoir characteristics to confirm the extent of solvent dilution that has occurred of the unextracted oil in the reservoir, and e. commencing gravity drainage based production from said reservoir upon said blend having a viscosity low enough to permit said blend to drain through said reservoir to a production well.

2. The solvent based in situ extraction process as claimed in claim 1 wherein said solvent injection step displaces solvent blocking liquids and gases from said oil extracted zone.

3. The solvent based in situ extraction process as claimed in claim 1 wherein said shutting in step includes a pressure monitoring step to monitor the degree of dissolution of said solvent into said oil.

4. The solvent based in situ extraction process as claimed in claim 1 wherein said step of commencing gravity based production includes producing the solvent/oil blend from a horizontal production well.

5. The solvent based in situ extraction process as claimed in claim 1 wherein said solvent is propane or ethane.

6. The solvent based in situ extraction process as claimed in claim 1 wherein said solvent prevents solvent blockers from slowing down the dilution of the solvent into the oil.

7. The solvent based in situ extraction process as claimed in claim 1 further including the step of recovering said solvent from said produced blend.

8. The solvent based in situ extraction process as claimed in claim 1 wherein pressure maintenance is performed on the reservoir during the extraction process.

9. The solvent based in situ extraction process as claimed in claim 1 wherein there is no pressure maintenance of the reservoir during the extraction process.

10. The solvent based in situ extraction process as claimed in claim 1 further including a step of measuring the solvent content of a produced blend and controlling a production rate based on said measured solvent content.

11. The solvent based in situ extraction process as claimed in claim 1 further including a step of injecting a pressure maintenance gas into the reservoir after solvent dilution of the in situ heavy oil has occurred.

12. The solvent based in situ extraction process as claimed in claim 1 wherein said step of removing mobile fluids comprises removing liquids and gases that are already present in the reservoir.

13. The solvent based in situ extraction process as claimed in claim 12 wherein mobile fluids are removed through existing wells located in the reservoir.

14. The solvent based in situ extraction process as claimed in claim 12 wherein said mobile fluids are removed by pumping.

15. The solvent based in situ extraction process as claimed in claim 1 wherein said extraction process includes a finishing step of blowing down the reservoir to recapture any remaining solvent.

16. The solvent based in situ extraction process as claimed in claim 1 wherein said step of injecting solvent as a vapour gradually pressurizes said reservoir with solvent to achieve a high liquid solvent loading of said reservoir.

17. The solvent based in situ extraction process as claimed in claim 1 wherein said cycle is repeated to extract additional oil from said reservoir.

18. The solvent based in situ extraction process as claimed in claim 1 further including a step of calculating an expected solvent penetration rate, comparing the solvent penetration rate to a measured pressure decline and commencing production when the solvent has been calculated to have progressed by a predetermined amount within the reservoir.

19. A multi-step in situ extraction process for heavy oil reservoirs, said process using a solvent and comprising the steps of:

a. decontaminating the reservoir by removing solvent blockers from the reservoir to create voids;

b. injecting said solvent in vapour form into said voids to raise the reservoir pressure until sufficient solvent is present in a liquid form to fill said voids;

c. shutting in said reservoir for a period of time to permit said solvent to diffuse into unextracted oil adjacent to said voids in a ripening step to create a reduced viscosity blend of solvent and oil; d. measuring one or more reservoir characteristics during said ripening step to estimate the extent of solvent dilution that has occurred of the unextracted oil in the reservoir, and e. commencing gravity drainage based production from said reservoir upon said blend having a viscosity low enough to permit said blend to drain through said reservoir to a production well.

20. A multi-step in situ extraction process for heavy oil reservoirs, said process using a solvent and comprising the steps of:

a. removing liquids and gases from areas in contact with said heavy oils to increase an interfacial area of unextracted heavy oil contactable by said solvent;

b. injecting said solvent in vapour form into said areas to raise the reservoir pressure until sufficient solvent is present in a liquid form to contact said increased interfacial area of said heavy oil;

c. shutting in said reservoir for a sufficient period of time to permit said solvent to diffuse into said unextracted oil across said interfacial area in a ripening step to create a reduced viscosity blend of solvent and oil;

d. measuring one or more reservoir characteristics to confirm the extent of solvent dilution that has occurred of the unextracted oil in the reservoir, and e. commencing gravity drainage based production from said reservoir when said blend has a viscosity which permits said blend to drain through said reservoir to a production well.

21. The solvent based in situ extraction process as claimed in claim 20 further including a step of calculating an expected solvent penetration rate, comparing the solvent penetration rate to a measured pressure decline and commencing production when the solvent has been calculated to have progressed by a predetermined amount within the reservoir.

* * * * *